United States Patent [19]

Konishi

[11] Patent Number: 4,943,715

[45] Date of Patent: Jul. 24, 1990

[54] LIMIT SWITCH HAVING MEANS TO EVALUATE ITS ACTUATING STROKE

[75] Inventor: Keisuke Konishi, Takatsuki, Japan

[73] Assignee: Omron Tateisi Electronics Co., Kyoto, Japan

[21] Appl. No.: 326,008

[22] Filed: Mar. 20, 1989

[30] Foreign Application Priority Data

Mar. 18, 1988 [JP] Japan ..... 63-66822

[51] Int. Cl.[5] ..... G01D 5/34

[52] U.S. Cl. ..... 250/229; 200/47

[58] Field of Search ..... 200/47; 250/229, 239

[56] References Cited

U.S. PATENT DOCUMENTS 4,556,768 12/1985 Atsumi et al. ..... 200/47

4,864,124 9/1989 Mirabella et al. ..... 250/229

*Primary Examiner*—David C. Nelms

*Attorney, Agent, or Firm*—Wegner & Bretschneider

[57] ABSTRACT

A limit switch having a fixed casing, an actuating part moveably support by the casing, and a pair of contact sets which are adapted to be activated by the movement of the actuating part, one for producing a normal switch output and the other for producing a stroke signal which serves as data for evaluating the appropriateness of the stroke of the actuating part. The other contact set may produce a signal when the actuating part has moved a certain distance more than the minimum stroke for activating the first contact set. Thus, the output from the second contact set ensures a certain stroke margin of the actuating part. Further, the second contact set may produce another stroke signal when the actuating part has been displaced close to the maximum permissible stroke of the actuating part so that an excessive stroke of the actuating part may be detected. The contact set may be purely mechanical or may also be a combination of a mechanical switch and a photoelectric switch.

7 Claims, 7 Drawing Sheets

LIMIT SWITCH HAVING MEANS TO EVALUATE ITS ACTUATING STROKE

TECHNICAL FIELD

The present invention relates to a limit switch which may be used in such various applications as detecting a prescribed limit of the movement of a mechanical component and detecting passage of an article, and in particular to such a limit switch which is provided with means to evaluate the appropriateness of its actuating stroke.

BACKGROUND OF THE INVENTION

Limit switches are widely used in various industrial applications, and they can detect a limit of movement of an article and passage of an article by displacement of an actuating part such as a pivotally supported arm or a linear plunger. For proper operation of such limit switches, it is necessary for the actuating part to undergo a certain displacement. However, even when a limit switch is initially mounted at an appropriate location, its position may shift in time. If such a shift is sufficiently small, no appreciable consequence may develop. However, it means that the safety margin of the operation of the limit switch may be substantially reduced without being known, and it may lead to an abrupt failure of the limit switch.

To avoid such an abrupt failure, it is desirable to monitor the safety margin of the operation of the limit switch so that an early warning may be made in case a potentially unreliable state of the limit switch is produced.

However, it is quite time consuming and difficult to inspect the accuracy of the position of each of a large number of limit switches that are used in various parts of a large manufacturing systems where such limit switches are typically used. Further, during the operation of such a system, most of the limit switches are typically inaccessible due to the presence of articles which are being conveyed and a considerable difficulty is encountered when an attempt is made to inspect the accuracy of the mounting positions of limit switches.

BRIEF SUMMARY OF THE INVENTION

In view of such problems of the prior art, a primary object of the present invention is to provide a limit switch which is provided with means to evaluate the actuating stroke of the limit switch so as to permit satisfactory monitoring of the operation of the limit switch.

A second object of the present invention is to provide a limit switch which is reliable in operation and simple in structure.

A third object of the present invention is to provide a limit switch having means to determine appropriateness of the stroke of its actuating part, irrespective of whether the stroke is excessive or insufficient.

These and other objects of the present invention will be achieved by providing a limit switch for detecting presence of an article as it passes by the limit switch relative thereto, comprising: a fixed casing; an actuating part supported by the casing so as to be moveable over a certain maximum operation range and is adapted to be actuated by the passing article; a first contact set which is adapted to produce a first switch output when displacement of the actuating part is smaller than a certain minimum operation stroke and a second switch output when displacement of the actuating part is larger than the minimum operation stroke; a second contact set which is adapted to produce a first stroke indicating output when displacement of the actuating part is smaller than a certain minimum acceptable stroke which is larger than the minimum operation value and a second stroke indicating output when displacement of the actuating part is larger than the minimum acceptable stroke; stroke evaluation means for evaluating the magnitude of the stroke of the actuation part according to a result of logical operation on outputs from the first and second contact sets.

Therefore, even when a normal switch output is obtained as a result of the movement of the actuating part, if the second stroke indicating output is not produced, it means that the stroke of the actuating part is insufficient and it can be readily determined that the limit switch is potentially unreliable. Therefore, necessary measures may be taken without involving serious and costly system failures.

In particular, if the second contact set is adapted to produce a third stroke indicating output when displacement of the actuating part is larger than a certain maximum permissible stroke which is larger than the minimum permissible stroke but within the maximum operation range, not only an insufficient stroke of the actuating part but also an excessive stroke thereof can be detected, and even more reliable management of limit switches is possible. To simplify the structure for accomplishing this, the third signal of the second contact set may be identical to the first signal of the second contact set.

According to a particularly preferred embodiment of the present invention, the stroke evaluation means comprises a counter which is adapted to count occurrence of transition from the first stroke indicating signal to the second stroke indicating signal and to be reset by occurrence of transition from the first switch output to the second switch output, and a comparator for comparing a count value of the counter with a fixed data upon detection of transition from the second switch output to the first switch output.

According to a preferred embodiment of the present invention, the second contact set comprises a fixed contact piece, and a moveable contact piece attached to the actuating piece by way of a buckling spring which urges the moveable contact piece into contact with the fixed contact piece when displacement of the actuating piece is less than the minimum permissible stroke, away from the fixed contact piece when displacement of the actuating piece is larger than the minimum permissible stroke but smaller than the maximum permissible stroke, and into contact with the fixed contact when displacement of the actuating piece is larger than the maximum permissible stroke.

According to another preferred embodiment of the present invention, the second contact set comprises a radiation energy emitting means and a radiation energy receiving means, one of them being fixed to the casing and the other of them being fixed to the actuating part, in such a manner that radiation energy is not transmitted between the radiation energy emitting means and the radiation energy receiving means when displacement of the actuating piece is less than the minimum permissible stroke, radiation energy is transmitted between the radiation energy emitting means and the radiation energy receiving means when displacement of the actuating piece is larger than the minimum permissible stroke but smaller than the maximum permissible stroke, and radiation energy is not transmitted between the radiation energy emitting means and the radiation energy receiving means when displacement of the actuating piece is larger than the maximum permissible stroke.

Thus, according to the present invention, it is possible to determine if the stroke of the actuating part of the limit switch is appropriate or not from a remote location without involving substantially any excessive cost or hazards, and failure of a limit switch may be detected even before it actually develops.

BRIEF DESCRIPTION OF THE DRAWINGS

Now the present invention is described in the following in terms of specific embodiments with reference to the appended drawings, in which.

DESCRIPTION OF THE PREFERRED EMBODIMENTS

Figure 2:
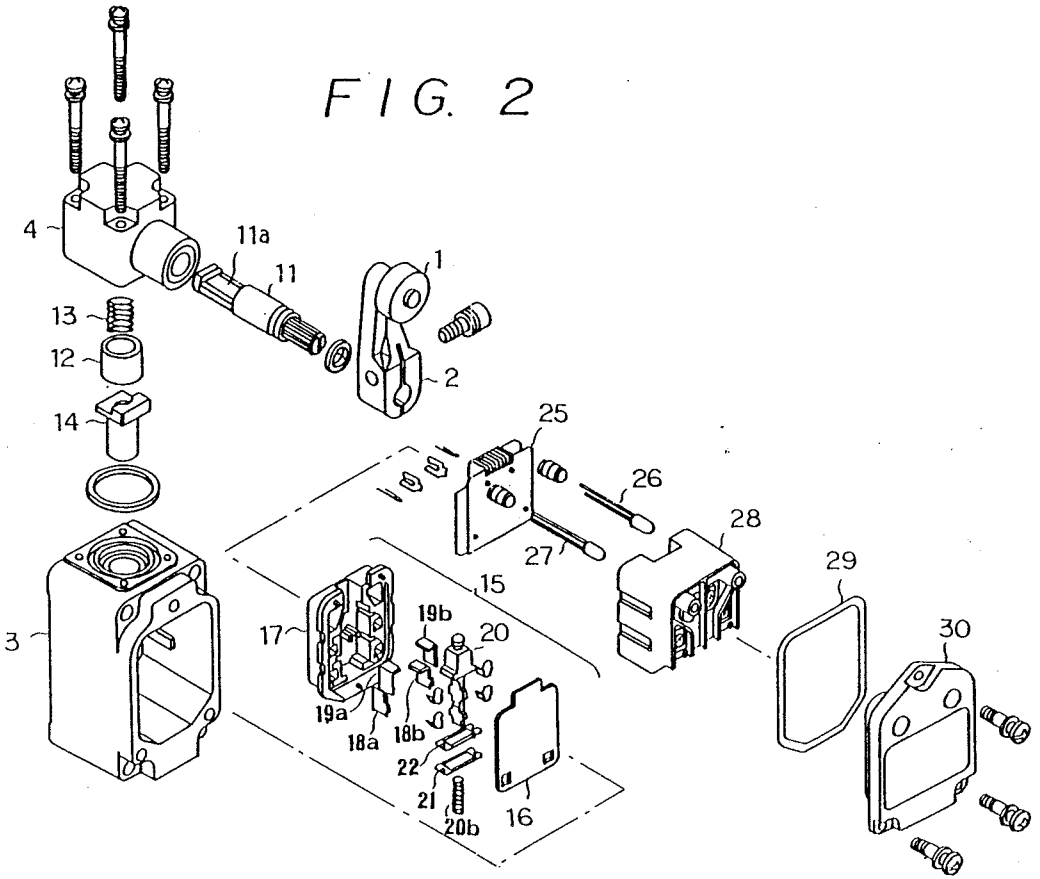
FIG. 2 is an exploded perspective view of the limit switch.
Figure 3A:
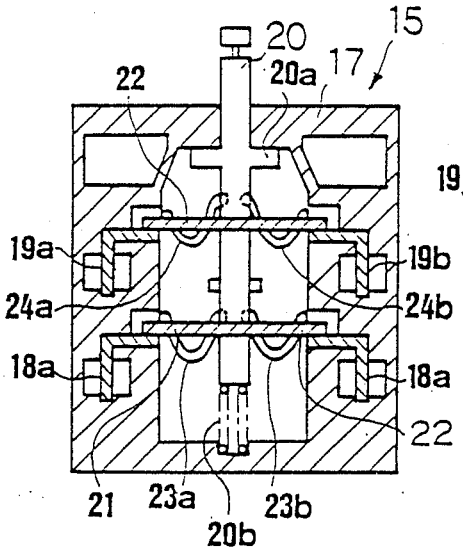
FIGS. 3(*a*), 3(*b*), 3(*c*) and 3(*d*) are sectional views showing different states of the internal switch.
Figure 3B:
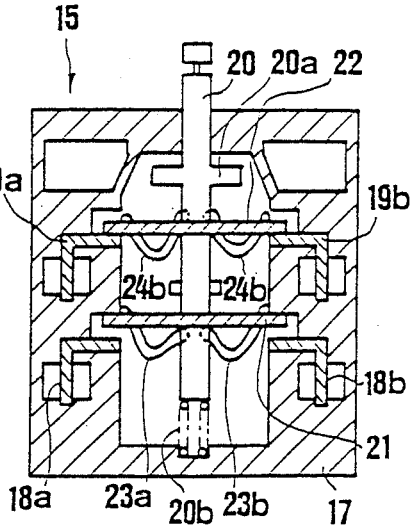
Figure 3C:
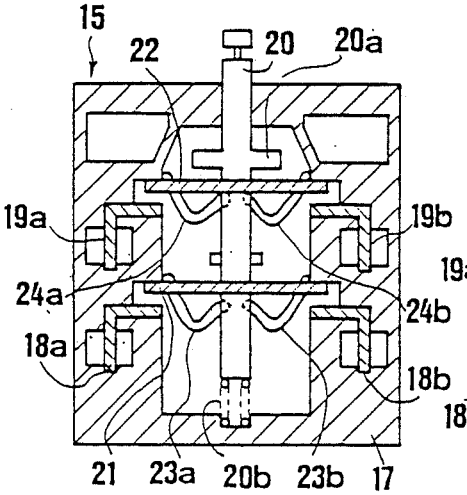
Figure 3D:
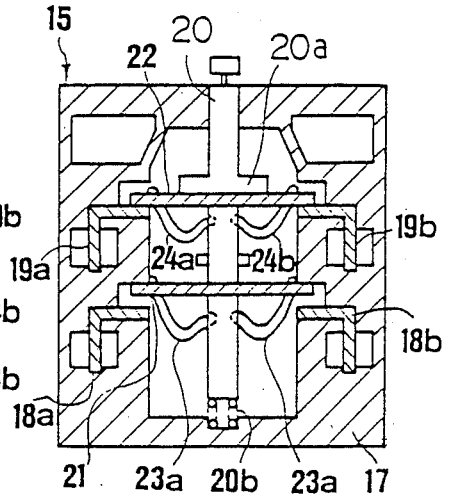

FIG. 2 is an exploded perspective view of the overall structure of a limit switch according to the first embodiment of the present invention. This limit switch comprises a casing 3, a head 4 securely attached to the casing 3 by screws, and a lever 2 pivotally supported by the head 4 by way of a pivot shaft 11 and having a roller 1 at its free end. Within the head 4, the pivot shaft 11 is provided with a flat portion 11*a* which aligns in parallel with the upper surface of the switch casing 3 when the lever 2 is at its neutral position, and a plunger 12, biased by a compression coil spring 13 that is interposed between the internal upper surface of the head 4 and the upper surface of the plunger 12, abuts the upper surface of the flat portion 11*a* of the pivot shaft 11 so as to urge the flat portion 11*a* to be parallel with the upper surface of the casing 3. To the lower surface of the flat portion 11*a* of the pivot shaft 11 abuts an actuation plunger 14.

The casing 3 is internally provided with an internal switch 15. The internal switch 15 is provided with a first and a second pair of L-shaped fixed contact pieces 18*a*, 18*b*, 19*a* and 19*b*, an actuation piece 20, and a first and a second planar moveable contact piece 21 and 22, which are interposed between a back plate 16 and a switch base 17 as shown in FIG. 2. The moveable contact pieces 21 and 22 are supported by the actuating piece 20 by way of bow-shaped springs 23*a*, 23*b*, 24*a* and 24*b* (FIG. 3(*a*)). The actuating piece 20 is urged outwardly by a compression coil spring 20*b* interposed between the innermost end of the actuating piece 20 and a bottom surface of the switch base 17, and a flange 20*a* integrally provided in the actuating piece 20 prevents the actuating piece 20 from coming entirely out of the switch base 17 under normal condition as shown in FIG. 3(*a*). Further, the moveable contact pieces 21 and 22 rest upon the corresponding fixed contact pieces 18*a* and 18*b*, and 19*a* and 19*b*, respectively, forming electric conductive paths between the fixed contact pieces 18*a* and 18*b*, and between the fixed contact pieces 19*a* and 19*b*, respectively.

When the actuating piece 20 is pushed into the switch base 17 against the spring force of the compression coil spring 20*b* as a result of the pivotal movement of the lever 2, the first contact set consisting of fixed contact pieces 18*a*, 18*b* and the moveable contact piece 21 is opened while the second contact set consisting of the fixed contact pieces 19*a*, 19*b* and the moveable contact piece 22 maintains its conductive state as shown in FIG. 3(*b*).

When the actuating piece 20 is pushed slightly deeper into the switch base 17, the second contact set 19*a*, 19*b* and 22 also opens as shown in FIG. 3(*c*).

When the actuating piece 20 is pushed even deeper into the switch base 17, the moveable contact piece 22 is pushed by the flange 20*a* and is brought into contact with the fixed contact pieces 19*a* and 19*b* against the spring force of the bow-shaped springs 24*a* and 24*b*.

Figure 4:
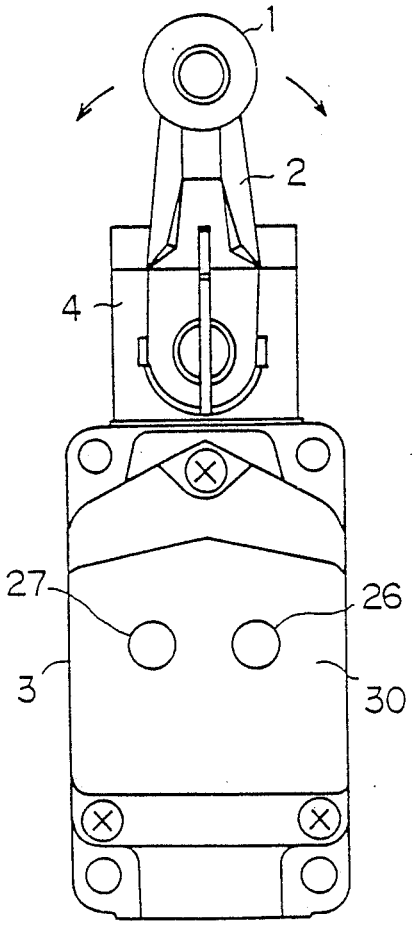
FIG. 4 is a front view of the limit switch.

The fixed contact pieces 18*a* through 19*b* are connected to electronic circuits carried by a printed circuit board 25 via a connector. The printed circuit board 25 carries light emitting diodes 26 and 27 for indicating the supply of power to the system and the occurrence of the movement of the arm 2 by an inappropriate stroke, and electronic circuits for producing a switch output and a actuating piece stroke monitoring output as described hereinafter. An upper part of the printed circuit board 25 is provided with a terminal block 28 carrying terminal pieces. A panel 30 is mounted on the open end of the casing 3 interposing a seal 29 therebetween. FIG. 4 is a front view of the thus constructed limit switch.

Figure 1:
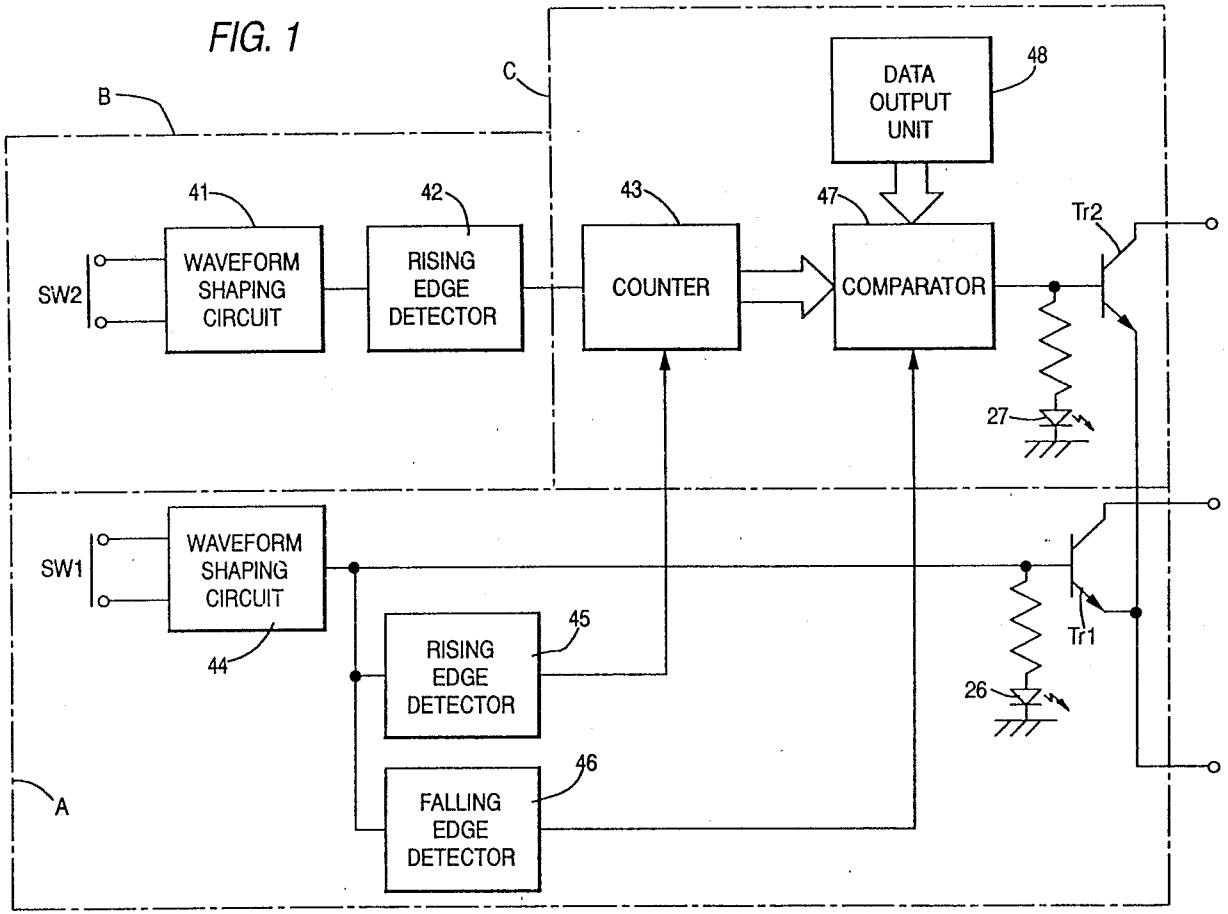
FIG. 1 is a block diagram showing the electric structure of an embodiment of the limit switch according to the present invention.

Now the electronic circuits mounted on the printed circuit board 25 are described in the following with reference to FIG. 1. The output from the switch SW1 formed by the fixed contact pieces 18*a* and 18*b* and the moveable contact piece 21 is supplied to a waveform shaping circuit 44. The waveform shaping circuit 44 shapes the switch signal which rises upon opening the fixed contact pieces 18*a* and 18*b*, and produces a switch output. This output is supplied to a rising edge detector 45 and a falling edge detector 46 as well as to an output transistor Tr1. The rising edge detector 45 sends a reset signal to a counter 43 upon detecting of a rising pulse edge. The output of the falling edge detector 46 is supplied to a comparator 47 as a comparison timing signal.

The output of the switch SW2 formed by the fixed contact pieces 19*a* and 19*b* and the moveable contact piece 22 is supplied to a waveform shaping circuit 41. The waveform shaping circuit 41 shapes the stroke indicating output which rises when the switch contact pieces 19*a* and 19*b* are opened, and sends it to a rising edge detector 42. The rising edge detector 42 gives a pulse corresponding to each rising pulse edge to the counter 43.

The counter 43 counts the pulse from the rising edge detector 42, and its count is given to the comparator 47. The comparator 47 compares the output from a data output unit 48 which stores data "1" in advance with the count of the counter 43 upon receiving of each output from the falling edge detector 46, and its output is supplied to the light emitting diode 27 and to the outside via a transistor Tr2.

The switch SW1, the waveform shaping circuit 44, the rising edge detector 45, the falling edge detector 46 and the transistor Tr1 jointly forms a switch circuit unit A which produces a switch output as a result of the displacement of the actuating piece 20 within an appropriate range. The switch SW2, the waveform shaping circuit 41, and the rising edge detector 42 jointly forms a stroke detecting circuit unit B which detects the stroke of the actuating piece 20. Further, the counter 43, the comparator 47, the data output unit 48 and the transistor Tr2 jointly form a stroke evaluating circuit unit C which produces a stroke indicating output according to the signals from the switch circuit unit A and the stroke detecting circuit unit B.

Now the operation of the present embodiment is described in the following with reference to the time chart shown in FIG. 5.

Initially, the internal switch 15 is in the state shown in FIG. 3(*a*), and the fixed contact pieces 18*a* and 18*b* and the fixed contact pieces 19*a* and 19*b* are both closed by the moveable contact pieces 21 and 22, respectively.

When an article passes this limit switch which is installed at a prescribed position and contacts the roller 1 at time t1, the lever 2 rotates. The rotation of the lever 2 causes a downward motion of the plunger 14 by way of the pivot shaft 11, and the actuating piece 20 of the internal switch 15 is accordingly pushed downward as shown by the curve given in FIG. 5(*a*). An article touches the roller 1 at the free end of the lever 2 at time t1, and, as the article pushes the lever 2 further, the actuating piece 20 reaches the position shown in FIG. 3(*b*) at time point t2, and the moveable contact piece 21 is pulled upward by the spring force of the bow-shaped springs 23*a* and 23*b*, thereby opening the contact of the switch SW1. Therefore, an output is obtained from the waveform shaping circuit 44 as shown in FIG. 5(*b*) with the result that the light emitting diode 26 is lighted and a switch output is produced from the transistor Tr1. At the time, since a rising pulse edge is produced from the wave shaping circuit 44, a reset signal is supplied from the rising edge detector 45 to the counter 43 to reset it.

When the actuating piece 20 is displaced to the position shown in FIG. 3(*c*), the fixed contact pieces 19*a* and 19*b* of the switch SW2 are also opened by the moveable contact piece 21 being pulled upward by the bow-shaped springs 24*a* and 234. Therefore, a rising edge detection signal is produced from the rising edge detector 42 at time t3 according to the output from the waveform shaping circuit 41 as shown in FIG. 5(*c*).

When the lever 2 has returned to its initial position due to the passage of an article, the output of the waveform shaping circuit 41 again falls to low level at time t4, and, after a slightly further returning motion of the lever 2, the switch output is also turned off at time t5. Therefore, a comparison timing signal is supplied to the comparator 47 from the falling edge detector 46 upon detection of a falling edge at time t5. Since the data "1" of the data output unit 48 agrees with the count of the counter 43, no warning output signal is produced as shown in FIG. 5(*d*).

However, it may happen that the mounting position of the limit switch has shifted from its proper position, and the rotational angle of the lever 2 and the stroke of the actuating piece 20 resulting from passage of an article may become excessively small. As shown in what following time point t6 in FIG. 5(*a*), if the stroke is excessively small upon passage of an article, a switch output is obtained from SW1 at time t7 as shown in FIG. 5(*b*), but no stroke indicating output is produced from the switch SW2 because the state shown in FIG. 3(*c*) is not produced or the conductive path between the fixed contact pieces 24*a* and 24*b* is never broken. Therefore, when, after the counter 43 is reset at time t7, the switch output is turned off at time t8 so as to cause a comparison timing signal to be given from the falling edge detector 46 to the comparator 47, the count of the counter 43 and the output of the data output unit 48 disagree from each other. Therefore, the comparator 47 produces a comparison output which lights up the light emitting diode 27 for warning and produces a warning output signal from the transistor Tr2.

This shows that the stroke of the lever 2 was not sufficient or appropriate, and proper action of the limit switch may not be maintained indefinitely even though a switch output is still produced, and no significant consequence has developed.

Further, as shown in what following time point t9, when the stroke of the actuating piece 20 has become excessively large due to a shift in the mounting position of the limit switch, a switch output is obtained from the switch SW1 at time t10 as the state shown in FIG. 3(*b*) is produced, and the counter 43 is reset. At time t11, the position shown in FIG. 3(*c*) is obtained, and a contact output is obtained from the switch SW2. As the actuating piece 20 is pushed down further, the moveable contact piece 22 is pressed by the flange 20*a* of the actuating piece 20, and the moveable contact piece 22 again comes into contact with the fixed contact pieces 19*a* and 19*b* at time t11' thereby closing electric connection therebetween as shown in FIG. 3(*d*).

When the actuating piece 20 has moved upwardly from the position shown in FIG. 3(*d*) to the position shown in FIG. 3(*c*), the fixed contact pieces 19*a* and 19*b* of the switch SW2 open, and the output of the waveform shaping circuit 41 again rises to high level at time t12 but further upward motion of the actuating piece 20 causes the fixed contact pieces 19*a* and 19*b* of the switch SW2 to be closed again as shown in FIG. 3(*b*) and the output level of the waveform shaping circuit 41 drops to low level again at time t'12.

When the actuating piece 20 has returned to its neutral poistion as shown in FIG. 3(*a*), the switch output from the fixed contact pieces 18*a* and 18*b* of the switch SW1 also drops to low level at time t13.

Thus, since rising edge detection signals are give from the rising edge detector 42 to the counter 43 at times t11 and t12, the count of the counter 43 which is then "2" and the data "1" from the data output unit 48 disagree from each other at time t13 when a comparison timing signal is given from the falling edge detector 46 to the comparator 47 at time t13. Therefore, at time t13, the comparator 47 produces a comparison output to light up the light emitting diode 27 and causes the transistor Tr2 to be conductive. Therefore, a warning signal is produced from Tr2 to warn that the stroke of the lever 2 is excessive and a potentially unstable state has been produced.

Thus, according to the present embodiment, a warning signal is produced from the transistor Tr2 either when the stroke of the lever 2 is insufficient or excessive.

The present embodiment uses one of the two contact sets of the internal switch 15 for producing a stroke indicating output (SW2), but other means may be used to produce an output which accounts for the stroke range of the lever 2 as compared with an initial or proper range. FIGS. 6(*a*) through 6(*d*) are simplified views of an example of the internal switch using a photo sensor for producing a stroke indicating signal. In this drawing, the moveable contact piece 21 is connected to the actuating piece 20 by way of bow-shaped springs in the same way as in the internal switch 15 of the previous embodiment so as to close and open contact between a pair of fixed contact pieces 18*a* and 18*b* according to its stroke as described earlier although in these drawings, the fixed contact pieces and the bow-shaped springs are omitted.

In the internal switch of this embodiment, a reflective body 51 is mounted on a part of the actuating piece 20. A photo sensor 52 is mounted on a part of the switch base 17 which opposes the reflective surface of the reflective body 51. As the actuating piece 20 is pushed in the direction indicated by the arrow as shown in FIG. 6(*b*) according to the rotation of the lever 2, the moveable contact piece 21 is displaced so as to open the contact between the fixed contact pieces 18*a* and 18*b* of the switch contact set SW1 in the state shown in FIG. 6(*b*), and further pushing of the actuating piece 20 causes the reflective body 51 to reach a position to oppose the photo sensor 52 as shown in FIG. 6(*c*). Therefore, in the same way as in the previous embodiment, the waveform shaped output is obtained according to the output from the photo sensor 52 as shown in FIG. 5(*c*).

Figures 5A, 5B, 5C, 5D:
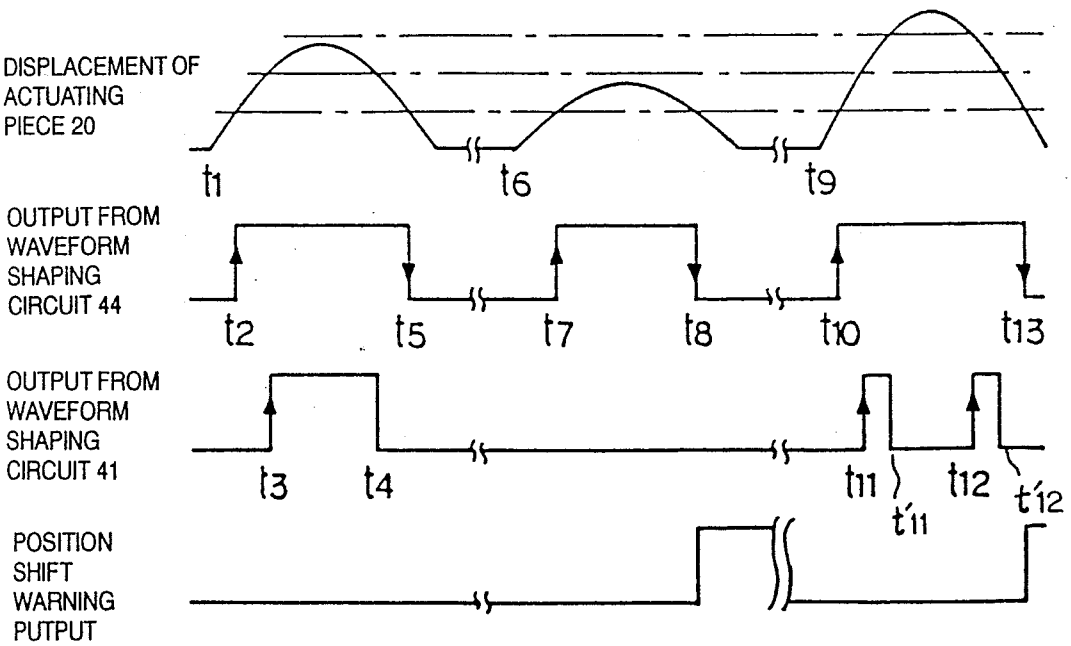
FIG. 5 is a time chart showing the change in the stroke of the actuating piece, the switch output and the positional stroke indicating output in relation with time.
Figure 6A:
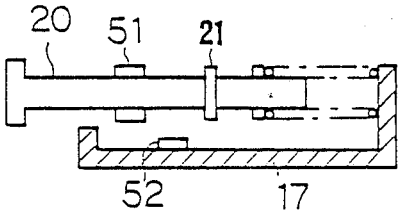
FIGS. 6(*a*), 6(*b*), 6(*c*) and 6(*d*) are sectional views showing different states of a second embodiment of the internal switch according of the invention.
Figure 6B:
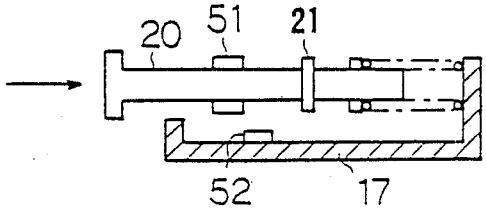
Figure 6C:
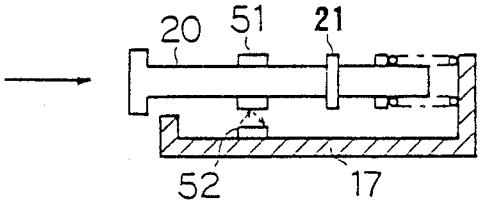
Figure 6D:
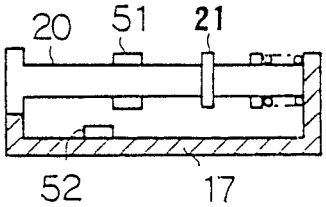

By setting the system so that an output may be obtained from the photo sensor 52 in the appropriate range of the stroke but no output may be obtained when the actuating piece 20 is pushed only to the extent shown in FIG. 6(*d*) of 6(*d*) as a result of the rotation of the lever 2 falling short of or exceeding the appropriate range of the rotation of the lever 2, the output from the photo sensor turns on and off following the time point t11 as shown in FIG. 5. Therefore, by using a similar circuit, shifting of the mounting position of the limit switch may be detected, either excessive or insufficient.

Figure 7:
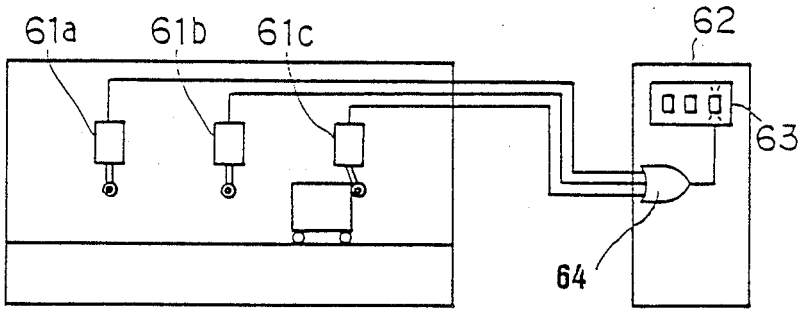
FIGS. 7(*a*) and 7(*b*) are views of article conveying systems using the limit switches which are based on the present invention.
Figure 7:
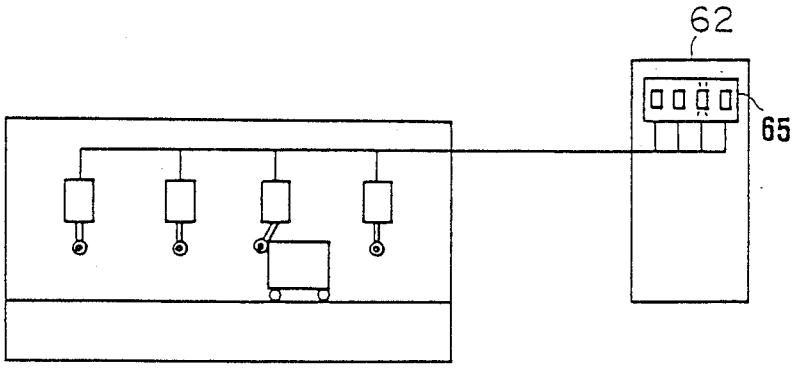

When an article conveying system is constructed as shown in FIG. 7(*a*) using a large number of limit switches 61*a* through 61*c* having the above described structure, an article detection signal and a positional shift warning output signal are obtained individually from each of the limit switches. Therefore, if a logical sum is taken of the positional shift warning signals from these limit switches and supplying it to a warning display unit 63, it is possible to display positional shift warning on a single display lamp which is placed in a part of a centrally controlled control panel 62. If positional shift detection signal outputs from a plurality of limit switches are individually given to a plurality of display units 64 as shown in FIG. 7(*b*), it is possible to identify the positional shift warning signal from each of the limit switches at the control panel 62.

In the above described embodiment, a range of the appropriate stroke was detected by using the contact output of a switch and a photo coupler, but it is also possible to use other means to detect a range of the appropriate stroke.

What we claim is:

1. A limit switch for detecting presence of an article as it passes by said limit switch, comprising:

a fixed casing;

an actuating part supported by said casing so as to be moveable over a certain maximum operation range and is adapted to be actuated by said passing article;

a first contact set which is adapted to produce a first switch output when displacement of said actuating part is smaller than a certain minimum operation stroke and a second switch output when displacement of said actuating part is larger than said minimum operation stroke;

a second contact set which is adapted to produce a first stroke indicating output when displacement of said actuating part is smaller than a certain minimum acceptable stroke which is larger than said minimum operation value and a second stroke indicating output when displacement of said actuating part is larger than said minimum acceptable stroke;

stroke evaluation means for evaluating the magnitude of the stroke of said actuation part according to a result of logical operation on outputs from said first and second contact sets.

2. A limit switch according to claim 1, wherein said stroke evaluation means comprises a counter which is adapted to count occurrence of transition from said first stroke indicating signal to said second stroke indicating signal and to be reset by occurrence of transition from said first switch output to said second switch output, and a comparator for comparing a count value of said counter with a fixed data upon detection of transition from said second switch output to said first switch output.

3. A limit switch according to claim 1, wherein said second contact set is adapted to produce a third stroke indicating output when displacement of said actuating part is larger than a certain maximum permissible stroke which is larger than said minimum permissible stroke but within said maximum operation range.

4. A limit switch according to claim 3, wherein said third signal of said second contact set is identical to said first signal of said second contact set.

5. A limit switch according to claim 4, wherein said stroke evaluation means comprises a counter which is adapted to count occurrence of transition from said first stroke indicating signal to said second stroke indicating signal and to be reset by occurrence of transition from said first switch output to said second switch output, and a comparator for comparing a count value of said counter with a fixed data upon detection of transition from said second switch output to said first switch output.

6. A limit switch according to claim 4, wherein said second contact set comprises a fixed contact piece, and a moveable contact piece attached to said actuating piece by way of a buckling spring which urges said moveable contact piece into contact with said fixed contact piece when displacement of said actuating piece is less than said minimum permissible stroke, away from said fixed contact piece when displacement of said actuating piece is larger than said minimum permissible stroke but smaller than said maximum permissible stroke, and into contact with said fixed contact when displacement of said actuating piece is larger than said maximum permissible stroke.

7. A limit switch according to claim 4, wherein said second contact set comprises a radiation energy emitting means and a radiation energy receiving means, one of them being fixed to said casing and the other of them being fixed to said actuating part, in such a manner that radiation energy is not transmitted between said radiation energy emitting means and said radiation energy receiving means when displacement of said actuating piece is less than said minimum permissible stroke, radiation energy is transmitted between said radiation energy emitting means and said radiation energy receiving means when displacement of said actuating piece is larger than said minimum permissible stroke but smaller than said maximum permissible stroke, and radiation energy is not transmitted between said radiation energy emitting means and said radiation energy receiving means when displacement of said actuating piece is larger than said maximum permissible stroke.

* * * * *